United States Patent [19]

Roda

[11] Patent Number: 4,749,327

[45] Date of Patent: Jun. 7, 1988

[54] MACHINE FOR TRANSFERRING BINS AND THE LIKE CONTAINERS

[75] Inventor: Cesare Roda, Cesena, Italy

[73] Assignee: Decco-Roda S.p.A., Bertinoro, Italy

[21] Appl. No.: 843,217

[22] Filed: Mar. 24, 1986

[30] Foreign Application Priority Data

Mar. 29, 1985 [IT] Italy ..... 3385 A/85

[51] Int. Cl.[4] ..... B66F 9/06

[52] U.S. Cl. ..... 414/589; 74/89.21; 74/665 GE; 294/81.52; 414/71; 901/16

[58] Field of Search ..... 414/70, 71, 750, 751, 414/589; 294/81.52, 67.32; 901/16, 33; 212/199, 211, 219; 474/148; 104/248, 235, 236; 187/9 E, 9 R; 74/89.21, 665 GE

[56] References Cited

U.S. PATENT DOCUMENTS

| | | | |
|---|---|---|---|
| 1,072,261 | 9/1913 | Riddle | 104/248 |
| 1,564,655 | 12/1925 | Westbo | 294/81.52 |
| 1,605,369 | 11/1926 | Miller | 104/248 |
| 2,858,009 | 10/1958 | Bainbridge | 414/71 X |
| 3,051,321 | 8/1962 | Ramsden | 212/219 X |
| 3,260,379 | 7/1966 | Bason | 414/71 X |
| 3,414,143 | 12/1968 | Scott | 212/219 X |
| 3,424,488 | 1/1969 | Renfroe | 294/81.52 X |
| 3,559,371 | 2/1971 | Borrowman | 294/81.52 X |
| 3,722,705 | 3/1973 | Gould | 212/219 X |
| 3,901,392 | 8/1975 | Streckert | 414/71 |
| 3,937,151 | 2/1976 | Monks | 104/236 X |
| 3,958,106 | 5/1976 | Bedford et al. | 212/219 X |
| 4,160,617 | 7/1979 | Montgomery et al. | 212/219 X |
| 4,172,685 | 10/1979 | Nabeshima | 212/219 X |
| 4,184,799 | 1/1980 | Arndt | 414/589 X |
| 4,187,784 | 2/1980 | Fernandez et al. | 104/235 |
| 4,222,461 | 9/1980 | Gunti | 187/20 |
| 4,242,025 | 12/1980 | Thibault | 901/16 X |
| 4,293,077 | 10/1981 | Makino | 212/219 |
| 4,409,650 | 10/1983 | Noguchi | 901/16 X |
| 4,481,005 | 11/1984 | Mann, Jr. | 474/148 X |
| 4,527,508 | 7/1985 | Juve | 414/589 X |
| 4,597,707 | 7/1986 | Cornacchia | 901/16 X |
| 4,599,032 | 7/1986 | Haus, Jr. | 104/236 X |

FOREIGN PATENT DOCUMENTS

| | | | |
|---|---|---|---|
| 537736 | 5/1955 | Belgium | 414/70 |
| 137590 | 11/1977 | Japan | 901/16 |
| 32557 | 3/1978 | Japan | 414/751 |
| 132956 | 10/1979 | Japan | 294/67.32 |
| 22455 | 2/1980 | Japan | 901/16 |
| 603577 | 4/1978 | U.S.S.R. | 901/16 |
| 1013386 | 4/1983 | U.S.S.R. | 294/67.32 |

OTHER PUBLICATIONS

FMC "Robot Case Palletizer/Depalletizer" brochure, Model 250, copyright 1984, 4 pages.

FMC "Robot Case Palletizer/Depalletizer" brochure, Model 500, copyright 1985, 4 pages.

FMC "Versatile Robot Palletizer" brochure, Models 500, 300, etc., 1985, 4 pages.

*Primary Examiner*—Robert J. Spar

*Assistant Examiner*—P. McCoy Smith

*Attorney, Agent, or Firm*—Guido Modiano; Albert Josif

[57] ABSTRACT

The machine comprises a tower, driven horizontally along two rails, on either side whereof loading and unloading stations are located. The tower carries pairs of guides, adapted for supporting lateral side members, movable in vertical and horizontal directions with respect to the tower. The lateral side members have at their bottom ends supporting members adapted for supporting the bin bases. The movable members of the machine being operatively linked to sensors effective to sense the presence of bins at the stations and to a selector unit for selecting the loading and unloading stations.

2 Claims, 2 Drawing Sheets

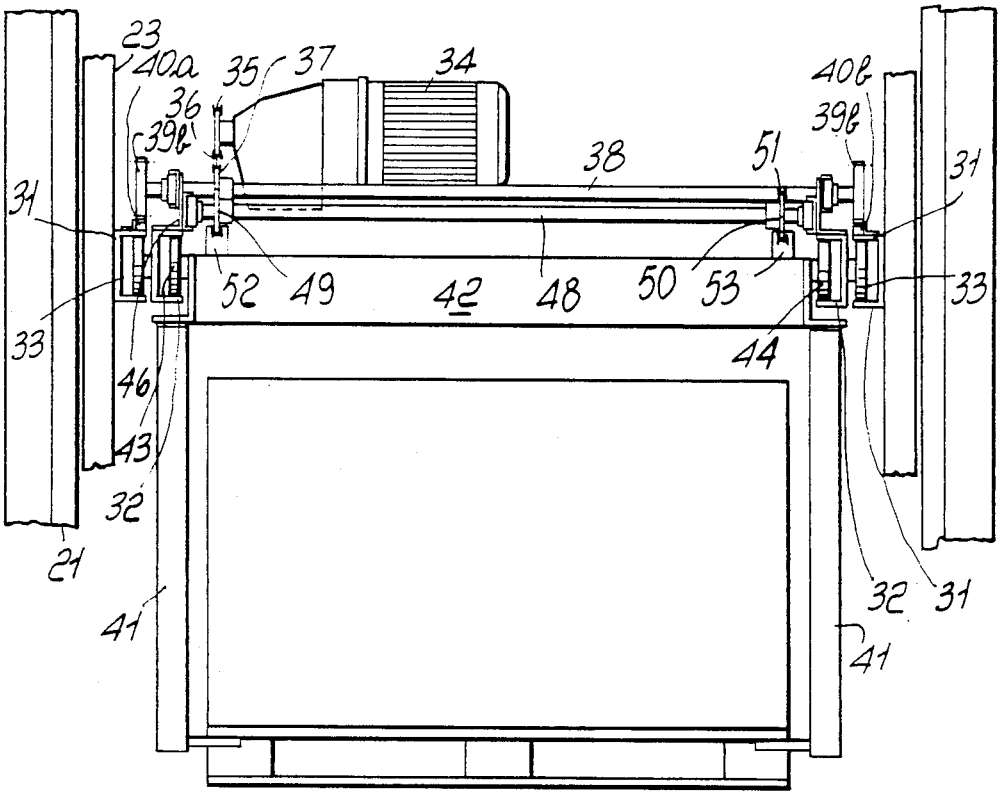
Fig. 4
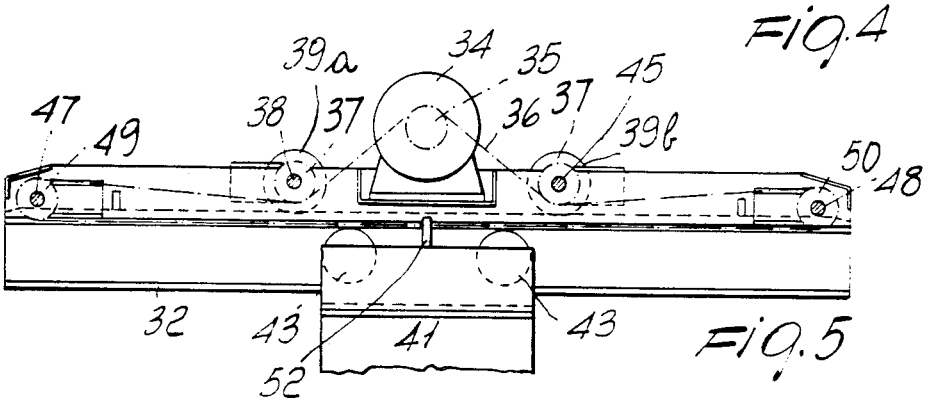
Fig. 5
Fig. 6
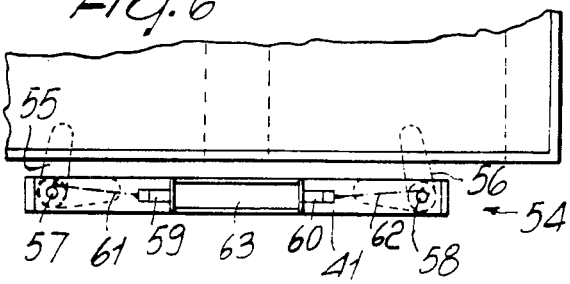
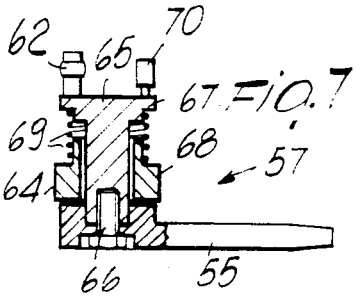
Fig. 7

MACHINE FOR TRANSFERRING BINS AND THE LIKE CONTAINERS

This invention relates to a machine for transferring bins and the like containers.

It is known that in garden/orchard produce sorting lines, the products are graded according to their characteristics of size, ripening, color, etc., and placed into containers or bins. The bins filled with the products, following the sorting step, are placed either on horizontal conveyors or on the floor and must be taken away and usually stacked in stacks of three bins each.

Heretofore, for the bin moving and stacking or transferring operations, it has been usual practice to use fork lift trucks, or alternatively, structures arranged at each station for moving and thus seperating the different grades of sorted-out produce. Such structures involve very high capital and running costs, since the sorting procedure can yield up to for instance, twenty different grades, and the bins loaded with the various sorted-out produce should be kept separated.

It is the technical aim of this invention to provide a machine which can transfer, from at least one loading station, to at least one unloading station, such bins on an automatic basis.

Within the above technical aim, it is an object of this invention to provide a machine which is versatile in the sense that its operational capabilities may be expanded as desired according to demand, and which can readily accommodate an increased number of loading or storage stations, or possibly relocation thereof.

Another object of this invention is to accomplish the above aim and object with a structure which is simple, relatively easy to manufacture, safe to use, and effective in operation, as well as of relatively low cost.

The above aim and these and other objects which will become apparent hereinafter are achieved by a machine for transferring bins and the like containers according to the invention which is characterized in that it comprises a tower, driven horizontally along a guide on either side whereof said stations are located and adapted for carrying at least two lateral side members, movable in vertical and horizontal planes and associated with the tower by means adapted to hold bottom edges thereof horizontal and having at their bottoms supporting members adapted for supporting bin bases, the machine's movable members being operatively linked to sensors, effective to sense the presence of bins at the stations and to a selector unit for selecting stations.

Further features will become apparent from the following detailed description of a preferred, though not exclusive embodiment of a machine for transferring bins according to the invention, in conjunction with the accompanying illustrative, but not limitative, drawings, where:

FIG. 4 is a side view of the movable members of the machine for transferring bins according to the invention;

FIG. 5 is a fragmentary detail front view of the crosspiece of the movable members of FIG. 4;

FIG. 6 is a fragmentary schematic plan view of the bin base supporting members; and FIG. 7 is a part-sectional, enlarged scale side view of a bin base supporting member of FIG. 6.

Figures 1, 2, 3:
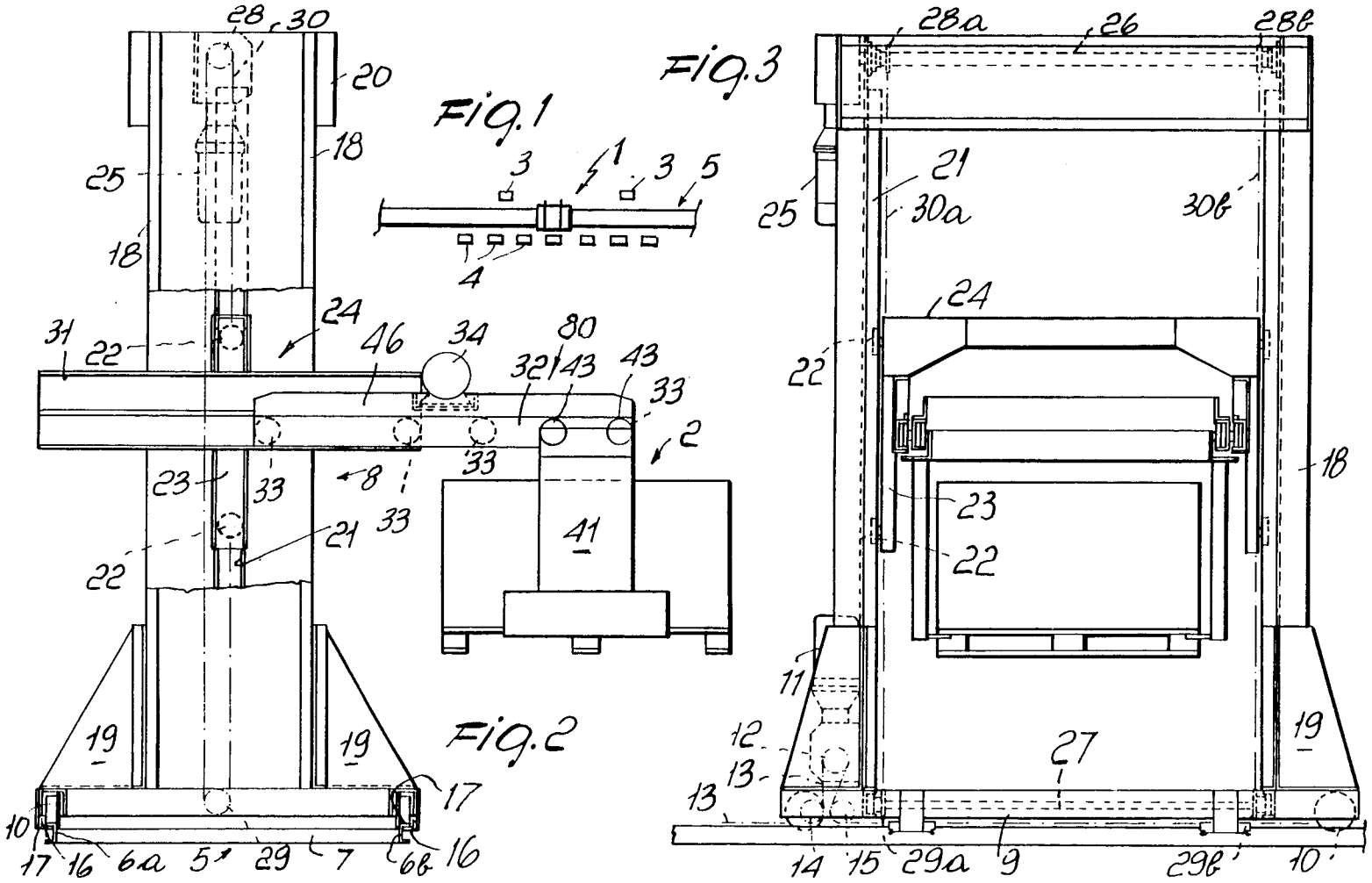
FIG. 1 is a diagramatic plan view of the inventive machine, as illustrated on a processing line.
FIG. 2 is a front view of the machine according to the invention.
FIG. 3 is a side view of the machine according to the invention.

With reference to the drawing figures, generally indicated at 1 is a machine according to the invention for transferring bins 2 from at least one loading station 3, and stacking and/or storing them at at least one unloading station 4. In FIG. 1 there are shown two loading stations 3 which may be positioned at ground level, or raised therefrom (for example, when the loading station corresponds to the delivery area of conveyor devices such as belt or roller conveyors), whereas a plurality of unloading stations 4 are provided for stacking on the floor a number of bins (e.g. three bins) one upon the other, but it should be understood that the unloading stations may also be raised off the floor as required, for example, in the instance of a vehicle loading bay, platform or similar structure. The machine 1 is arranged to be movable horizontally along a guide or line 5. In the example shown, the loading stations 3 are arranged on one side of the guide, and the unloading stations 4 on the other side of the guide 5, but it should be understood that, obviously, all of the loading and unloading stations 3 and 4 may be arranged to lie on the same side of the guide 5 or located at random on either sides of said guide 5.

The guide 5 comprises preferably two rails *6a,6b*, formed preferably from tubular section members, each having a rectangular cross-section and being joined together by floor-mounted sleepers 7.

The machine 1 comprises a tower 8 which has a rectangular bed 9 which may be formed, for example, from metal sectional members welded together. Rotatably mounted below the bed 5 are four wheels 10 expediently of the kind having an outer side flange for accurately guiding movement of the tower 8 along the rails *6a, 6b*. The tower 8 is driven along the rails *6a,6b* by a gear motor set 11 advantageously mounted to the machine bed and having keyed to its output shaft a drive sprocket wheel 12, around which a bed drive chain 13 is entrained. The bed drive chain 13 is passed downwardly around two idle sprockets 14, 15 idly mounted on the bed 9 and has its ends attached to the ends of the guide 5 constituted by the rails *6a, 6b*. Thus, operation of the gear motor set 11 to drive the drive sprocket wheel 12 in either direction is effective to drive the tower 8 along the guide 5 in either a forward or a reverse direction.

To prevent the tower 8 from overbalancing, to the sides of the bed 9 there are attached shoes 16 carrying on their upper surfaces facing the rails *6a, 6b*, a lining made of an antifriction material, and slidably engaging with the bottom faces of lateral flanges 17 of the rails *6a, 6b*.

From the bed 9 there extend vertically upward four uprights 18, which define the tower 8, and expediently include, welded to the bed bottom, respective triangular stiffening gussets 19. the uprights 18 are joined at their upper extremities by crosspieces 20. Along the front and rear faces of the tower 8, between the bed and the crosspieces 20, there are centrally secured two vertical guides 21 each having an inwardly open U-shaped cross-section.

Guided along the vertical guides 21 by means of idle rollers 22 are two vertically arranged front elements 23, which are interconnected at their upper ends by a platform 24. Attached to the top of the tower 8 is a gear motor 25 adapted for driving a first shaft 26 journalled close to the towers' centerplane. On the tower base there is journalled a second shaft 27 coplanar with respect to the first shaft 26. Mounted on the first and second shafts 26 and 27 are respective first and second pairs of sprockets 28*a*,28*b* and 29*a*,29*b* around which are disposed a first drive chain 30*a*, and a second drive chain 30*b*, which have their respective ends attached to the platform 24 and the lower ends of the front elements 23. The active runs of the drive chains 30 are aligned with the vertical guides 21, whereas their return runs extend outward of the guides. Thus, operation of the gear motor 25 in either direction will drive the platform 24 up or down the tower 8.

Attached to the front elements 23 of the platform 24 are two substantially horizontally arranged transverse guides 31 having U-shaped cross-sections open towards each other. Between the transverse guides 31 there is mounted a horizontal framework 80 including two horizontal transverse guides 32 also having U-shaped cross-sections which are open towards each other, and which have substantially the same length as the transverse guides 31. Journalled to the outward face of each horizontal transverse guide 32 are guide rollers 33, which are guided on the transverse guides 31 and enable the horizontal transverse guides 32 to move outwardly beyond the ends of the transverse guides 31 at both sides of the tower 8 by more than half of the length of the horizontal transverse guide 32 (see FIG. 2).

The movement of the framework 80 along transverse guides 31 is effected by a gear motor set or drive motor 34 rigidly associated with the framework 80 and adapted to drive, through a transmission including a drive pinion 35, chain 36, and two sprockets 37, two longitudinal shafts 38, 45, rotatably journalled on the framework and each having two gears 39*a*, 39*b* keyed to its opposite ends which mesh with respective racks 40*a*, 40*b* secured above the transverse guides 31. Obviously, instead of the racks 40*a*, 40*b*, any suitable means could be used, for instance it would be possible to mount chain sections having their ends rigidly associated with the ends of the transverse guides 31 or even cable means. Along the horizontal transverse guides 32 there are mounted two horizontally movable lateral side members 41 upwardly joined together by crosspieces 42, and having journalled thereto, pairs of idle rollers 43, 44, adapted for movement along the horizontal transverse guides 32. (See FIG. 4). Above and throughout the length of the horizontal transverse guides 32 there are secured two sectional members 46 adapted for rotatably supporting the cited longitudinal shafts 38, 45, and two driven shafts 47, 48. To the opposite ends of each of the shafts 47, 48 there are keyed respective driven sprockets 49, 50 which are kinematically connected together by the chain 36 meshing with the sprockets 37 and the drive pinion 35 and by another chain 51 meshing with the drive sprockets 50. The chains 36 and 51 as shown in FIG. 5, have their ends attached to respective tabs 52,53, rigidly associated with the crosspieces 42.

With the cited arrangement, operation of the drive motor 34 in either a forward or reverse direction, not only causes the framework 80 to move along, and to overhang from the transverse guides 31, but also causes the guide rollers 33 journalled to the lateral side members 41 to move along the horizontal transverse guides 32. (See FIGS. 2 and 5). Downwardly on each lateral side member 41 at a bottom portion thereof, there is provided a supporting member 54 for the bin bases which comprises two tongues or supporting arms 55, 56 journalled at two vertical pins 57, 58 mounted for rotation at the two lower ends of the lateral side members 41. The supporting arms 55, 56 are interconnected by two juxtaposed rods 59, 60 articulated to small connecting rods 61, 62 in turn articulated at their ends to the supporting arms 55, 56. The rods 59, 60 are expediently driven by an electromagnetic device 63 in opposite directions. Upon activating the electromagnetic device 63, the supporting arms 55, 56, move from a release position underlying the respective lateral side members 41, (shown in phantom-lines in FIG. 6), to a position for supporting the bins 2 shown in full lines.

To ensure that the supporting arms 55, 56, release the bins when the bins 2 are brought to bear on a rest surface, a constructional arrangement of the arm 55 of the type shown in detail in FIG. 7 may be advantageously provided. Attached to each of the lateral side members 41 is a pair of bushes 64, each having slidably mounted therein, a shank 65, which is slidable in a vertical direction. Each shank has a respective supporting arm 55, 56, fastened to its lower end by a bolt 66. Between two respective flanges 67,68 formed on the shank 65 and the bush 64, there is a compression coil spring 69 which is effective to bias the supporting arm 55, 56 upward against the base of the bush 64 and to hold the top of the shank 65 at an elevated level in contact with the feeler of a microswitch 70 rigidly associated with the lateral side member 41 when the supporting arm 55, 56 is unloaded (i.e. relieved of the weight of the bin). When the supporting arm is instead loaded, i.e. when a force is exerted thereon from above, the shank 65 moves downwards within the bush 64 and thus breaks its contact with the feeler of the microswitch. The microswitch 70 is electrically connected (circuit-wise) to the electromagnetic device, 63 so as to enable the bins 2 to be only released when the supporting arm is unloaded (raised), that is, with the bin 2 rested on the ground or on top of another bin.

It should be noted that the supporting arms 55, 56, in their gripping configuration fit below the bin base at the openings provided in the bin base which are usually utilized to accommodate the forks of fork lift trucks. It should be understood, however, that the bins may be of a different type from the one shown, and may comprise any suitable container, pallet, or vessel, and that the arms may be adapted for engagement with a containment structure in another manner, for example, such arms may be arranged to fit below a peripheral bottom border of a bin or vessel.

The machine's movable members are expediently operatively linked to sensors for sensing the presence of bins arranged on the tower flanks and/or under the lateral side member 41, and to a centralized unit for selecting the loading and unloading stations, respectively. It should be further noted that, to avoid excessive unbalances and lateral mechanical interference, as the tower moves along the rails 6*a*, 6*b*, the platform and the side members 41 are preferably carried substantially at the centerline of the tower 8.

By changing the platform's elevation, the position of the horizontal transverse guides 32, and of the pairs of lateral side members 41, and the position of the tower 8 along the rails 6*a*, 6*b*, it becomes possible to operate with loading and unloading stations variously arranged on either side of the rails 6*a*, 6*b* and at different levels.

With produce sorter plants having a very high number of loading and unloading stations or a very high operating rate, it is envisaged that two or more machines according to the invention may be set to operate on the same rails *6a, 6b*.

The machine of this invention may be advantageously employed not only for transferring produce filled bins but also to take emptied bins to the loading stations. It will be appreciated that whilst reference has been made to a selection line for horticultural produce, the machine could be employed in other types of selection, production or assembly lines.

Thus, it has been shown how the invention achieves the cited objects.

The invention herein is susceptible to many modifications and changes without departing from the scope of the inventive concept.

Furthermore, all the details are replaceable with technical equivalents thereof.

In practicing the invention, any materials, shapes and dimensions, may be used as required, without deviating from the protection scope of the appended claims.

I claim:

1. A machine for transferring bins and the like containers comprising:

a tower including a bed, wheel means journalled to said bed, upright means fixedly projecting vertically from said bed and defining at least one side of said tower and at least one other side of said tower, and cross pieces adapted for connecting said upright means, horizontal rail means on which said tower is movably arranged, first drive means for driving said tower along said horizontal rail means, vertical guide means fixed to said upright means, a platform slidably mounted on said vertical guide means, second drive means mounted on said tower for raising and lowering said platform along said vertical guide means, first horizontal guide means provided on said platform perpendicularly to said horizontal rail means, a framework slidably mounted on said platform and including second horizontal guide means extending parallel to said first guide means, bin supporting means slidably mounted on said framework and third drive means for moving said framework along said first horizontal guide means and said bin supporting means along said second horizontal guide means, said first horizontal guide means permitting projection of said framework outwardly from said platform from one side between the upright means to an opposite side of said tower, wherein said third drive means comprises a gear motor mounted on said framework and having a driving pinion, rack means fixed to said platform and extending parallel to said first horizontal guide means, shaft means rotatably supported on said framework, gear and sprocket means rotatably connected to said shaft means, said gear means meshing with said rack means, and chain means wound around said sprocket means and said driving pinion and attached to said bin supporting means thus causing simultaneous moving of said framework and bin supporting means along said first and second horizontal guide means respectively.

2. A machine as defined in claim 1, wherein said bin supporting means comprises a crosspiece having rollers for movement along said second horizontal guide means, two side members projecting downwardly from said crosspiece, two pairs of bushes, each pair being attached to a respective side member, shanks rotatably supported and vertically slidable inside said bushes;

bin carrying arms rotatably fixed to said shanks, actuating means mounted on each side member to simultaneously rotate said shanks to swing said arms between a bin carrying and a bin releasing position, spring means arranged between said shanks and said bushes and urging said shanks into a raised position, switch means operatively associated to said shanks and controlling said actuating means to swing said arms into said bin releasing position when the shanks are in said raised position.

* * * * *